US005842956A

United States Patent [19]

Strachan

[11] Patent Number: 5,842,956

[45] Date of Patent: Dec. 1, 1998

[54] STRENGTH RESISTANCE TRAINING JUMP ROPE

[76] Inventor: Kenneth L. Strachan, 14209 Dunwood Valley Dr., Bowie, Md. 20721

[21] Appl. No.: 703,877

[22] Filed: Aug. 27, 1996

[51] Int. Cl.[6] ..... A63B 5/22

[52] U.S. Cl. ..... 482/82; 482/81

[58] Field of Search ..... 482/81, 82, 74, 482/121, 125, 126, 907; 472/135

[56] References Cited

U.S. PATENT DOCUMENTS

| | | | |
|---|---|---|---|
| 67,101 | 7/1867 | Browne | 482/81 |
| 1,436,703 | 11/1922 | Fisher . | |
| 2,942,881 | 6/1960 | Recalma | 482/82 |
| 3,107,092 | 10/1963 | Morris | 482/82 |
| 3,219,342 | 11/1965 | Melchiona | 482/126 |
| 3,415,515 | 12/1968 | Otto | 272/75 |
| 4,109,906 | 8/1978 | Wilson | 482/82 |
| 4,293,125 | 10/1981 | Hinds | 272/75 |
| 4,315,623 | 2/1982 | Granderson | 482/81 |
| 4,489,934 | 12/1984 | Miller | 482/82 |
| 4,563,002 | 1/1986 | Jardine | 272/75 |
| 4,593,903 | 6/1986 | Waitz | 272/122 |
| 4,776,585 | 10/1988 | Maleyko et al. | 272/75 |
| 4,787,623 | 11/1988 | Cedar | 272/74 |
| 5,022,646 | 6/1991 | Kessler | 272/75 |
| 5,054,772 | 10/1991 | Winston | 482/82 |
| 5,058,883 | 10/1991 | Dybvik | 272/93 |
| 5,211,612 | 5/1993 | Carbonero | 482/81 |
| 5,215,509 | 6/1993 | Meyer | 482/82 |
| 5,234,393 | 8/1993 | Heinrich | 482/82 |
| 5,445,586 | 8/1995 | Yun | 482/82 |
| 5,514,058 | 5/1996 | Buoni et al. | 482/125 X |
| 5,533,952 | 7/1996 | Schaber | 482/70 |

*Primary Examiner*—Jerome Donnelly
*Assistant Examiner*—Denise Pothier
*Attorney, Agent, or Firm*—Aquilino & Welsh

[57] ABSTRACT

A resistance jump rope for strength and cardiovascular conditioning, wherein the jump rope includes a first handle having a first end and a second end and a second handle having a first end and a second end. The jump rope further includes a first elongated, flexible cord having a first end and a second end. The first end of the cord is rotatably coupled to the first end of the first handle and the second end of the cord is rotatably coupled to the first end of the second handle. The jump rope also includes a second resilient cord which is substantially shorter than the first cord. The second cord includes a first end and a second end, wherein the first end of the second cord is secured to the first handle and the second end of the second cord is secured to the second handle. In use, an individual may rotate the handles such that the first cord moves in a circular arc over which the individual may jump as it passes by the legs of the individual and the individual may move the first and second handles away from each other to create resistance in the second cord to isometrically exercise the upper body of the individual.

19 Claims, 4 Drawing Sheets

STRENGTH RESISTANCE TRAINING JUMP ROPE

BACKGROUND OF THE INVENTION

1. Field of the Invention

The present invention relates to strength training devices, and in particular, to jump ropes suitable for providing strength and cardiovascular conditioning.

2. Description of the Prior Art

Devices such as bar bells and dumb bells used in strength exercise programs result, to a small degree, in minimal increases in blood circulation. They are at best, therefore, minimally effective insofar as conditioning the circulatory and respiratory systems. On the other hand, devices used in exercise programs designed to provide cardiovascular and respiratory conditioning are structured differently from those used in strength conditioning.

Further, while strength conditioning exercises normally require physical exertion at a slow pace to work and fatigue certain muscles, cardiovascular exercises usually involve a high degree of quickly performed repetitious movements without interruption. The constant activity provided in cardiovascular exercises causes increased blood circulation and respiration.

Since the exercises and devices used to provide strength conditioning are, for the most part, diametrically opposed to the exercises and devices used in cardiovascular conditioning, means have been sought whereby a single device can provide strength, cardiovascular and respiratory conditioning.

Jump ropes are often used as part of popular exercise programs directed to cardiovascular and respiratory conditioning. Athletes, such as boxers and basketball players, engaging in exercise programs including jump ropes develop better balance, foot quickness, and cardiovascular conditioning. However, any strength conditioning provided by exercising with jump ropes is limited almost entirely to the legs.

Because of the popularity of exercise programs employing jump ropes, attempts have been made to improve the strength conditioning effects provided by jump ropes. For example, prior jump ropes have employed a plurality of external weights fixedly about the cord or rope section. In addition, prior jump ropes have included weights in the interior of a hollow cord section of the rope to improve the strength conditioning characteristics of the jump rope.

Unfortunately, jump ropes including weights along their cord sections pose a substantial risk of injury to the exerciser, as well as others in the immediate vicinity of the rotating jump rope. If, for example, the weighted cord section, which is moving at high rotational speeds, accidentally strikes the individual using the jump rope or an individual in the immediate vicinity, that person could be seriously injured. A further disadvantage attendant to the use of jump ropes including additional weights resides in the fact that repeated striking of the floor by the weighted cord section wears or damages either the floor, the rope or both. Finally, the periodic jolting imparted to the joints of an exerciser's wrists, elbows and shoulders as a result of the combination of centrifugal and gravitational forces acting on the increased weight cord sections of the rope (wherein the weight becomes zero upon striking the floor and resumes its normal load after leaving the floor), results in repeated shock that is counter-productive to the strength and cardiovascular conditioning values sought.

After studying the prior art, it is apparent that a need continues to exist for a training device capable of providing strength, cardiovascular and respiratory conditioning in the same training device. In addition, it is apparent that a needs continues to exist for an improved jump rope capable of providing an individual strength, cardiovascular and respiratory conditioning. The present invention is a training device providing the user with strength, cardiovascular and respiratory conditioning, while overcoming the limitation of prior exercise devices. individual may rotate the handles such that the first cord moves in a circular arc over which the individual may jump as it passes by the legs of the individual and the individual may move the first and second handles away from each other to create resistance in the second cord to isometrically exercises the upper body of the individual.

It is also an object of the present invention to provide a jump rope wherein the second cord is rubber.

It is a further object of the present invention to provide a jump rope wherein the first cord is releasably secured to the first handle and the second handle.

It is another object of the present invention to provide a jump rope wherein the first cord is rubber.

It is also an object of the present invention to provide a jump rope wherein the second cord is releasably secured to the first handle and the second handle.

It is a further object of the present invention to provide a jump rope wherein the first end of the second cord is secured to an end cap on the first handle and the second end of the second cord is secured to an end cap on the second handle, and the end cap on the first handle and the end cap on the second handle are releasable secured to the respective first handle and second handle permitting an individual to selective remove the second cord from the first handle and the second handle.

SUMMARY OF THE INVENTION

The present jump rope permits physical fitness programs combining strength, cardiovascular and respiratory conditioning in the use of a single training device. The present jump rope provides full conditioning without the need for placing weights in the interior of a hollow cord section or the jump rope handle, the risks of increased weight cord sections striking and injuring the exerciser or another party, and the damage and wear to the floor or rope resulting from the constant striking of the jump rope. Moreover, use of the present jump rope does not subject the user to the jolting effect inherent in jump ropes including additional weights along the cord section of the jump rope.

It is, therefore, an object of the present invention to provide a resistance jump rope for strength and cardiovascular conditioning, wherein the jump rope includes a first handle having a first end and a second end and a second handle having a first end and a second end. The jump rope further includes a first elongated, flexible cord having a first end and a second end. The first end of the cord is rotatably coupled to the first end of the first handle and the second end of the cord is rotatably coupled to the first end of the second handle. The jump rope also includes a second resilient cord which is substantially shorter than the first cord. The second cord includes a first end and a second end, wherein the first end of the second cord is secured to the first handle and the second end of the second cord is secured to the second handle. In use, an It is another object of the present invention to provide a jump rope wherein the first handle includes an end housing at the first end of the first handle, and the first end of the first cord is secured to the end housing; and the second handle includes an end housing at the first end of the second handle, and the second end of the first cord is secured to the end housing.

It is also an object of the present invention to provide a jump rope wherein the end housing of the first handle includes a tapered opening adjacent the first end of the first rope and the end housing of the second handle include tapered opening adjacent the second end of the first rope.

It is a further object of the present invention to provide a jump rope further including first and second solid bearings respectively mounting the first cord to the first and second handles.

It is another object of the present invention to provide a jump rope wherein the first end of the first cord is secured to the first bearing by a first pin integral with the first end of the first cord and the second end of the first cord is secured to the second bearing by a second pin integral with the second end of the first cord, wherein the first and second pins respectively prevent the first and second solid bearings from slipping off of the first cord and for ease of adjusting length of the first cord.

It is also an object of the present invention to provide a training jump rope including a first handle having a first end and a second end and a second handle having a first end and a second end. The jump also includes a first elongated, flexible cord having a first end and a second end, wherein the first end of the cord is releasably and rotatably coupled to the first end of the first handle and the second end has a resistance device secured thereto. The jump rope further includes a second elongated, flexible cord having a first end and a second end, wherein the first end of the cord is releasably and rotatably coupled to the first end of the second handle and the second end has a resistance device secured thereto. The provision of the first and second cords with a resistance device secured at a second ends thereof permits an individual to learn to jump rope without the frustration associated with consistently getting your feet tangle with an elongated, flexible cord.

It is also an object of the present invention to provide a training jump rope wherein the resistance device is an air resistance ball.

It is also an object of the present invention to provide a training jump rope further including a second resilient cord. The second cord includes a first end and a second end, wherein the first end of the second cord is secured to the first handle and the second end of the second cord is secured to the second handle. In use, an individual may move the first and second handles away from each other to create resistance in the second cord which isometrically exercises the upper body of the individual.

It is also an object of the present invention to provide a training jump rope wherein the first cord is releasably secured to the first handle and the second cord is releasably secured to the second handle, such that the first cord and the second cord can be replaced by an elongated, flexible third cord which is secured between the first handle and the second handle.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
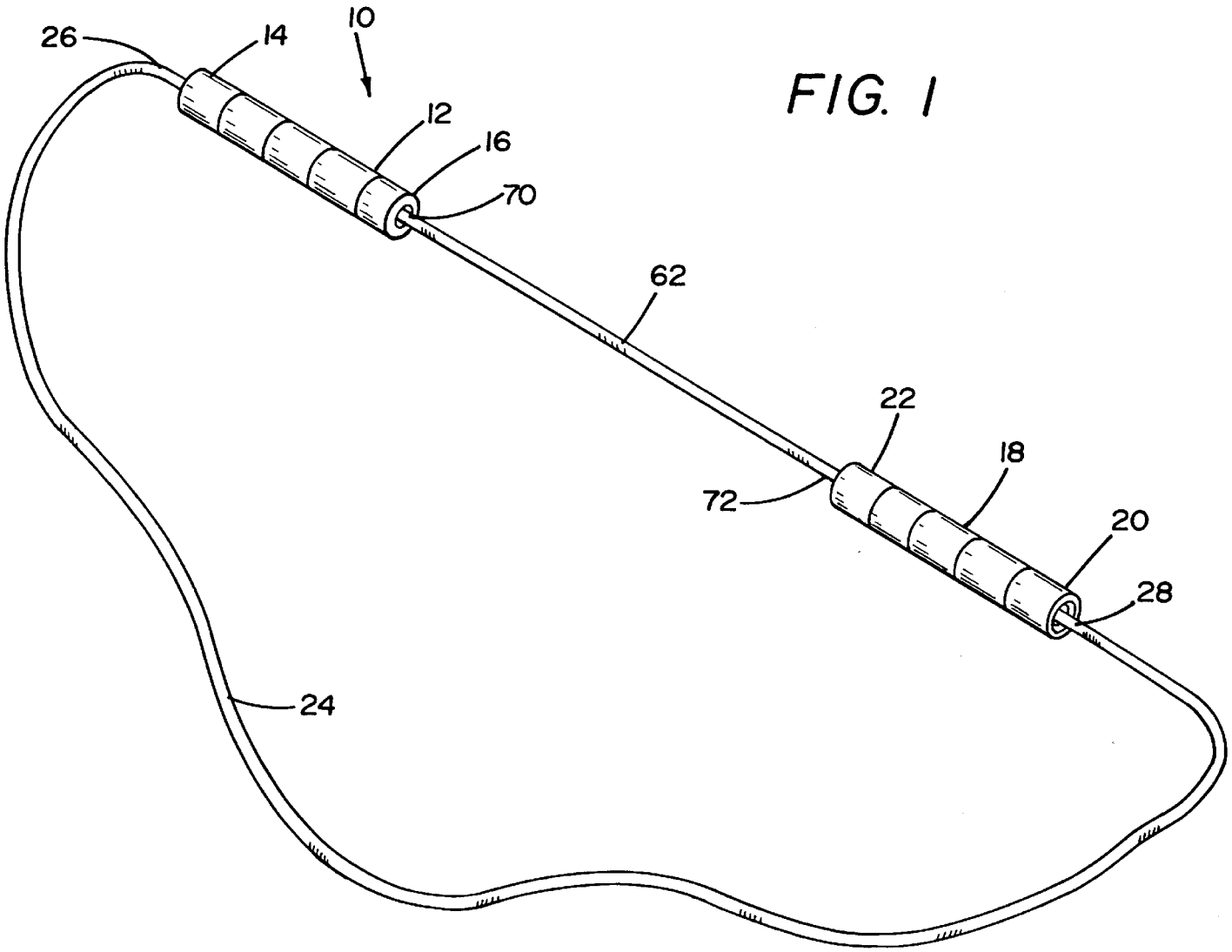
FIG. 1 is a perspective view of the present jump rope.
Figure 2:
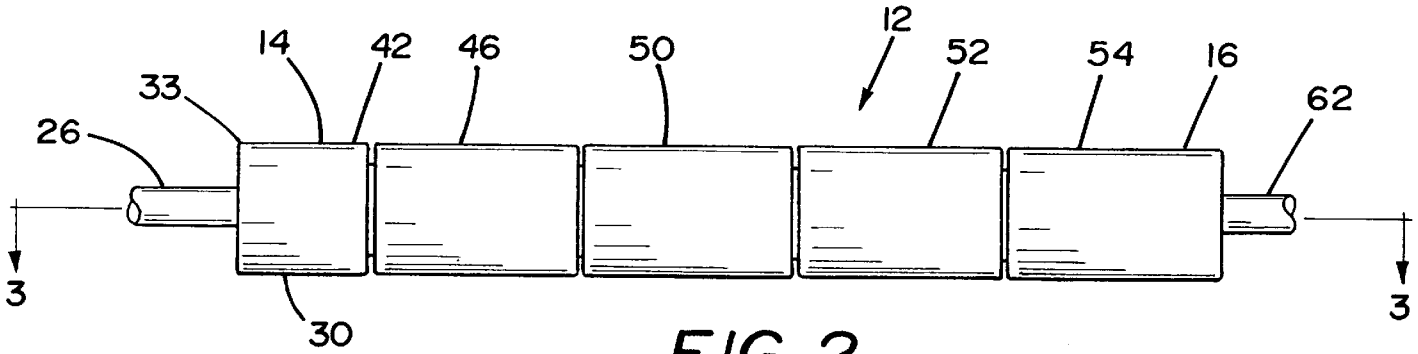
FIG. 2 is a plan view of the first handle of the present jump rope.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to the figures, the present jump rope 10 is shown. As with conventional jump ropes, the present jump rope 10 includes a first handle 12 having a terminal first end 14 and a terminal second end 16 with two end faces, a second handle 18 having a terminal first end 20 and a terminal second end 22 with two end faces, and an elongated, flexible cord 24 secured between the first end 14 of the first handle 12 and the first end 20 of the second handle 18. Specifically, the elongated, flexible cord 24 includes a first end 26 secured to the first end 14 at an end face of the first handle 12 and a second end 28 secured to at an end face of the second handle 18. In accordance with the preferred embodiment of the present invention, the elongated, flexible cord is preferably manufactured from buna (rubber). However, the elongated, flexible cord could be manufactured from a variety of materials without departing from the spirit of the present invention.

The handle structure is shown in greater detail in FIGS. 2–5. While the first handle is shown in FIGS. 2–5, it should be understood that the first and second handles are identical. The first handle 12 includes a series of selectively interconnected elements. Specifically, an end housing 30 is located at the first end 14 of the first handle 12. The end housing 30 includes a shoulder 32 at its first end 33 on which a solid bearing 34 sits to rotatably secure the first end 26 of the flexible cord 24 to the first handle 12. The cord 24 is secured to the solid bearing 34 and passes through an opening 36 in the first end 33 of the end housing 30. Preferably, the cord 24 is secured to the solid bearing 34 by the provision a pin 38 integrally secured to the end of the cord 24. In this way, the cord 24 is secured to the solid bearing 34 such that the cord 24 will not slip from the bearing 34. In addition, the length of the cord can readily be adjusted by simply moving the pin 38 to a different location along the length of the cord.

Rotation of the cord 24 adjacent the first end 33 of the end housing 30 is enhanced by the provision of an outwardly tapered surface 40 adjacent the opening 36 of the first end 33 of the end housing 30. The tapered surface 40 prevents the cord 24 from rubbing against the surface of the end housing 30. The lack of contact between the cord and the end housing reduces wear to the cord and encourages smooth rotation of the cord.

Figure 3:
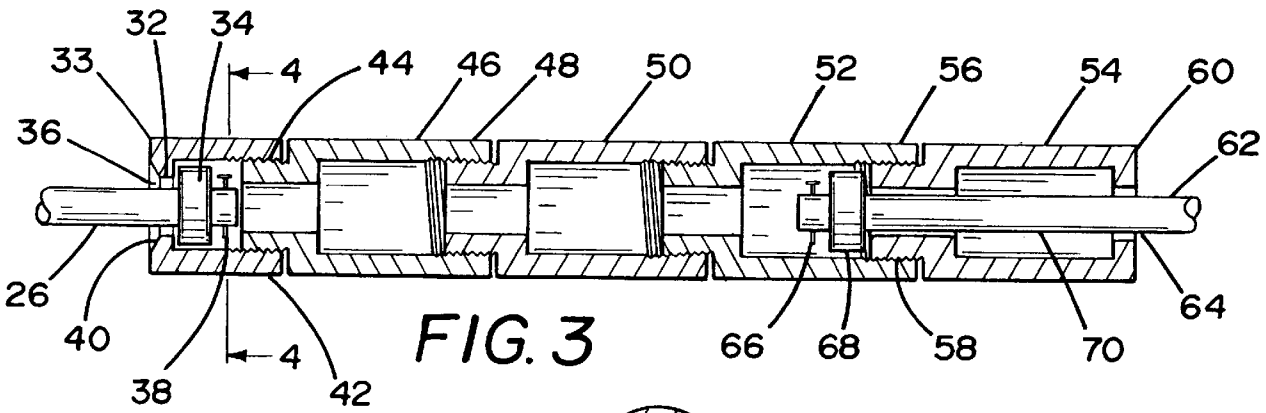
FIG. 3 is a cross-sectional view of the first handle along the line III—III in FIG. 2.
Figure 4:
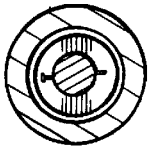
FIG. 4 is a cross-sectional view of the first handle along the line IV—IV in FIG. 3.
Figure 5:
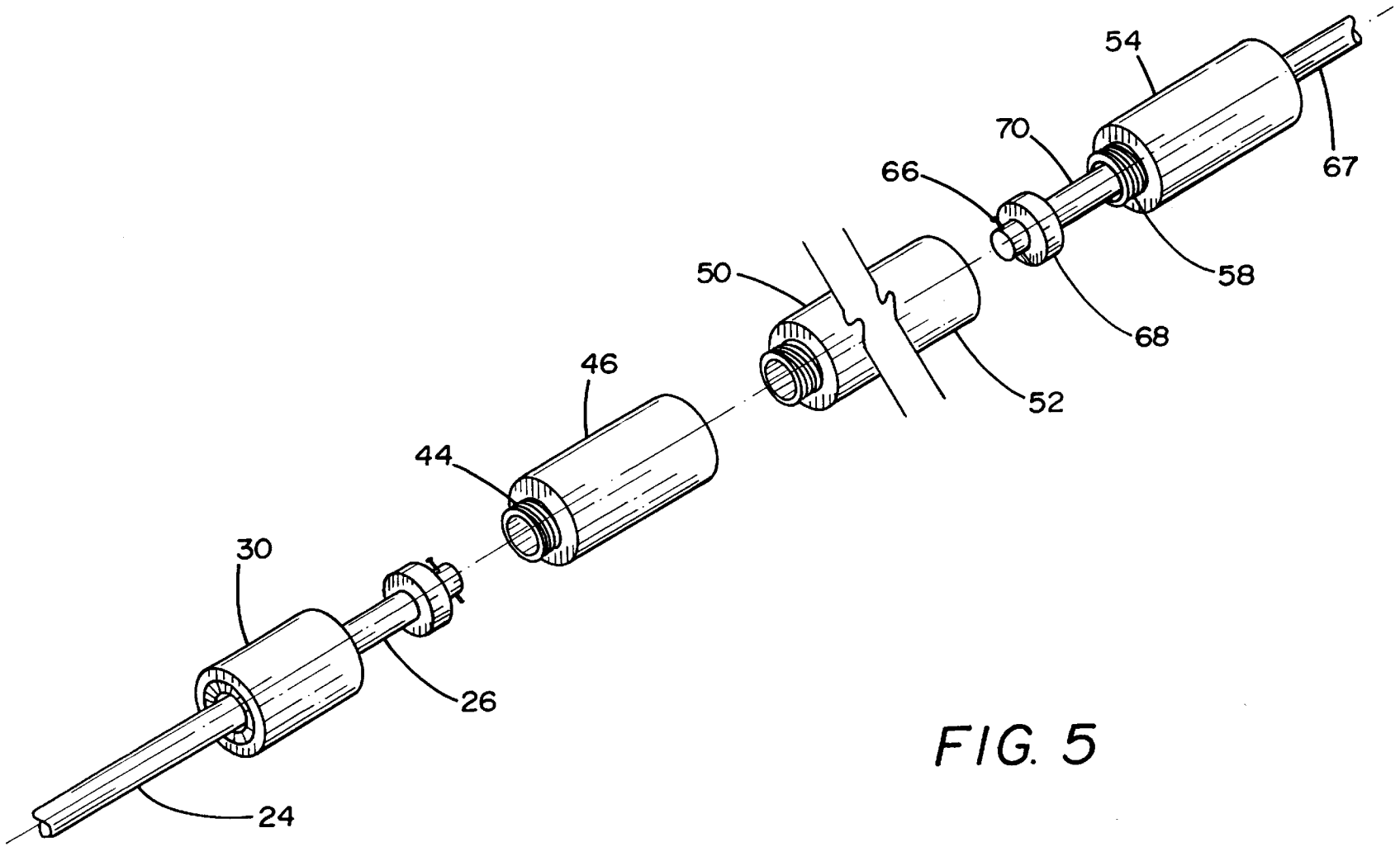
FIG. 5 is an exploded view of the first handle.

The second end 42 of the end housing is internally threaded to accept an externally threaded end 44 of the first handle element 46. The opposite end 48 of the first handle element 46 is internally threaded to accept a second handle element 50 in the same manner the first handle element 46 is secured to the end housing 30. Similarly, a third handle element 52 is secured to the second handle element 50 in the same manner the second handle element 50 is secured to the first handle element 46. As shown in FIG. 3, the end housing 30, the first handle element 46, the second handle element 50 and the third handle element 52 are hollow, and are thus adapted to selectively receive resistance structures therein (for example, weights). These elements are selectively secured to each other by way of their threaded ends, and it should be understood that handle elements may be removed or added by an individual user without departing from the spirit of the present invention.

An end cap 54 is secured to the internally threaded end 56 of the third handle element 52. The end cap 54 includes an externally threaded end 58 which is secured to the internally threaded end 56 of the third handle element 52 and a closed end 60 which closes off the interior of the handle 12. A resilient cord 62 extends from an opening 64 in the closed end 60 of the end cap 54. The resilient cord 62 is shorter than the elongated flexible cord 24, for reasons that will become readily apparent. The resilient cord 62 may be secured to the end cap in any conventional manner, for example, with a pin 66 and a bearing 68 as discussed above with regard to the elongated cord 24.

With reference to FIGS. 1–3 and 5, the resilient cord 62 has a first end 70 which is secured to the second end 16 at an end face of the first handle 12 in the manner discussed above and a second end 72 secured to the second end 22 at an end face of the second handle 18 in a manner identical to the first handle 12. The resilient cord 62 is preferably a buna (rubber) cord, although other resilient materials could be utilized without departing from the spirit of the present invention.

As should be apparent from the previous disclosure, the resilient cord may be removed from the first handle and the second handle by simply removing the end cap of the first handle and the end cap of the second handle. As a result, if an individual wishes to utilize the jump rope without the resilient cord attached thereto, he or she may simply remove the end caps supporting the resilient cord and replace those end caps with end caps having a completely closed end (not shown). Similarly, the jump rope will remain useful, if the individual simply removes the end caps supporting the resilient cord and uses the jump rope with the interior of the first and second handles exposed.

In use, an individual rotates the handles in a conventional manner, causing the elongated, flexible cord to rotate in a circular arc. The individual then jumps over the rope as he or she would with any conventional jump rope. While the individual is using the jump rope in a conventional manner, the individual may move the first and second handles away from each other to create resistance in the resilient cord. The resistance provided by the resilient cord isometrically exercises the upper body of the individual. The characteristics of the buna resilient cord create increased resistance as the handles are moved further and further apart. As a result, the individual may vary the resistance applied to his or her upper body by simply changing the distance between the first and second handles.

Figure 6:
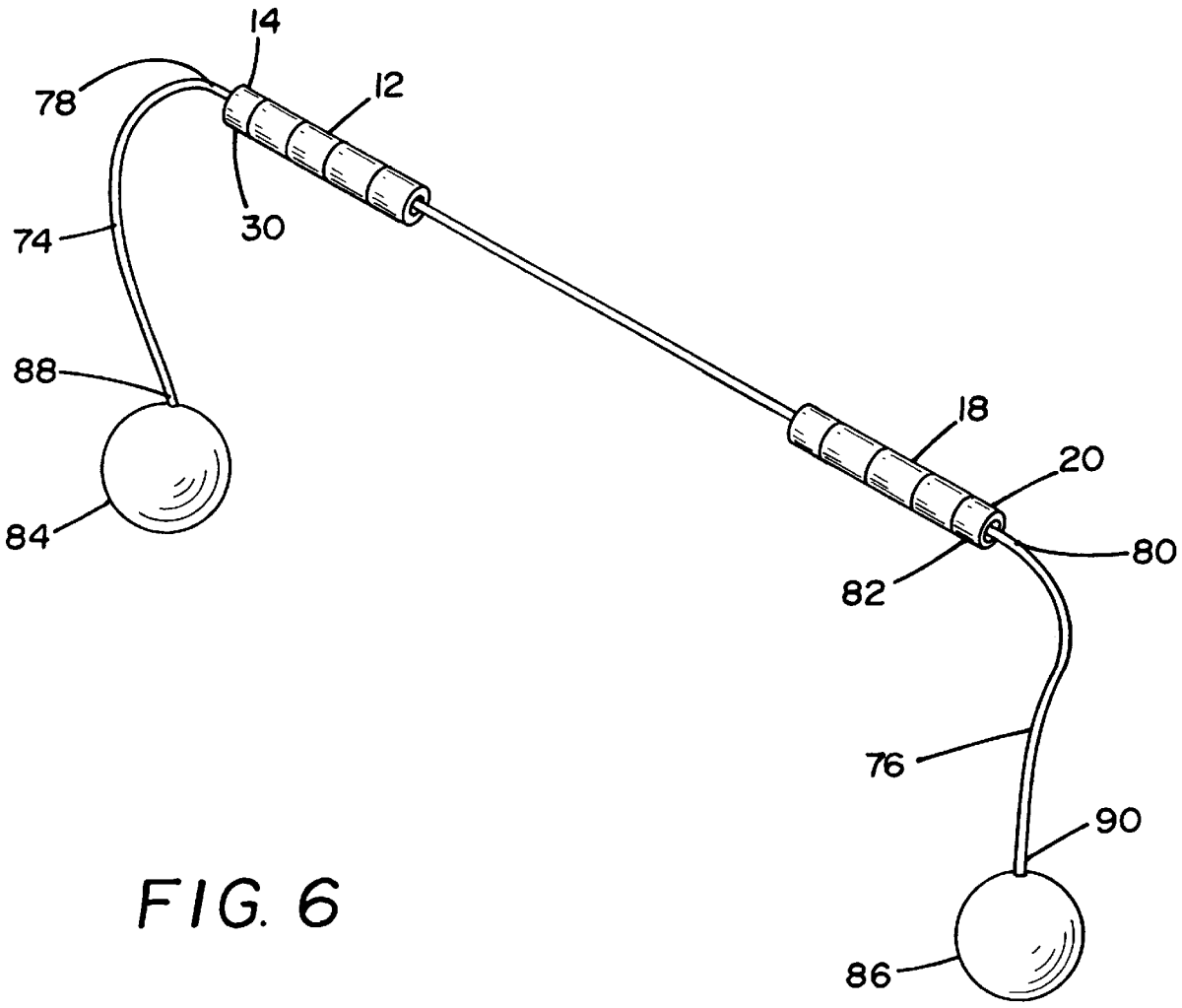
FIG. 6 is an alternate embodiment of the present jump rope.

An alternate embodiment of the present invention is shown in FIG. 6. The alternate embodiment is identical to the embodiment disclosed above, with the exception that the elongated, flexible cord is replace by a first cord 74 secured to the first end 14 of the first handle 12 and a second cord 76 secured to the first end 20 of the second handle 18. The first cord 74 includes a first end 78 secured to the end housing 30 of the first handle 12 and the second cord 76 includes a first end 80 secured to the end housing 82 of the second handle 18. The first cord 74 and the second cord 76 are secured to the respective end housings in the same manner that the elongated, flexible cord is secured to the end housings in the embodiment discussed above.

The first and second cords also include an air resistance ball 84, 86 (for example, a WHIFFLE BALL, that is, a ball having holes therein to vary the flow of air around and through the ball) secured at their respective second ends 88, 90. The provision of the first and second cords with an air resistance ball secured at a second end thereof permits an individual to learn to jump rope without the frustration associated with consistently getting your feet tangle with the elongated, flexible cord.

In use, the individual simply rotate the handles as he or she would do with a conventional jump rope. Rotation of the handles causes the first and second cords to rotate in a manner similar to the cord of a conventional jump rope. This creates the effect of jumping rope for the novice jump roper, and provides the individual with the rhythmic feel associated with jumping rope. The individual may then practice jumping with the rhythm of the rope. When the individual feels comfortable, he or she is then ready to begin using a conventional jump rope.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A resistance jump rope for strength and cardiovascular conditioning, comprising:

a first handle including a terminal first end and a terminal second end and a second handle including a first end and a second end;

a first elongated, flexible cord sized and shaped to move in a circular arc about an individual as the cord passes by the leas of the individual having a first end and a second end, the first end of the cord being coupled to the first end of the first handle and the second end of the cord being coupled to the first end of the second handle; and a second resilient cord, substantially shorter than the first cord, the second cord including a first end and a second end, wherein the first end of the second cord is secured to the first handle and the second end of the second cord is secured to the second handle such that the second resilient cord extends between the second end of the first handle and the second end of the second handle; wherein the individual using the jump rope may rotate the handles such that the first cord moves in a circular arc over which the individual may jump as it passes by the legs of the individual and the individual may move the first and second handles away from each other to create resistance in the second cord to isometrically exercise the upper body of the individual.

2. The jump rope according to claim 1, wherein the second cord is rubber.

3. The jump rope according to claim 2, wherein the second cord is buna rubber.

4. The jump rope according to claim 1, wherein the first cord is releasably secured to the first handle and the second handle.

5. The jump rope according to claim 4, wherein the first cord is rubber.

6. The jump rope according to claim 1, wherein the second cord is releasably secured to the first handle and the second handle.

7. The jump rope according to claim 6, wherein the first end of the second cord is secured to an end cap on the first handle and the second end of the second cord is secured to an end cap on the second handle, and the end cap on the first handle and the end cap on the second handle are releasably secured to the respective first handle and second handle permitting an individual to selectively remove the second cord from the first handle and the second handle.

8. The jump rope according to claim 1, wherein the first handle includes an end housing at the first end of the first handle, and the first end of the first cord is secured to the end housing; and the second handle includes an end housing at the first end of the second handle, and the second end of the first cord is secured to the end housing.

9. The jump rope according to claim 8, wherein the end housing of the first handle includes a tapered opening adjacent the first end of the first cord and the end housing of the second handle include tapered opening adjacent the second end of the first cord.

10. The jump rope according to claim 1, further including first and second solid bearings respectively mounting the first cord to the first and second handles.

11. The jump rope according to claim 10, wherein the first end of the first cord is secured to the first bearing by a first pin integral with the first end of the first cord and the second end of the first cord is secured to the second bearing by a second pin integral with the second end of the first cord, wherein the first and second pins respectively prevent the first and second solid bearings from slipping off of the first cord and for ease of adjusting length of the first cord.

12. A resistance jump rope for strength and cardiovascular conditioning, comprising:

a first handle including a terminal first end and a terminal second end and a second handle including a first end and a second end;

a first elongated, flexible cord size and shaped to move in a circular arc about an individual as the cord passes by the legs of the individual having a first end and a second end, the first end of the cord being coupled to the first end of the first handle and the second end of the cord being coupled to the first end of the second handle, wherein the first handle includes an end housing at the first end of the first handle, and the first end of the first cord is secured to the end housing; and the second handle includes an end housing at the first end of the second handle, and the second end of the first cord is secured to the end housing; and a second resilient cord, substantially shorter than the first cord, the second cord including a first end and a second end, wherein the first end of the second cord is secured to the first handle and the second end of the second cord is secured to the second handle such that the second resilient cord extends between the second end of the first handle and the second end of the second handle; wherein an individual using the jump rope may rotate the handles such that the first cord moves in a circular arc over which the individual may jump as it passes by the legs of the individual and the individual may move the first and second handles away from each other to create resistance in the second cord to isometrically exercise the upper body of the individual.

13. The jump rope according to claim 12, wherein the end housing of the first handle includes a tapered opening adjacent the first end of the first cord and the end housing of the second handle includes a tapered opening adjacent the second end of the first cord.

14. The jump rope according to claim 12, further including first and second solid bearings respectively mounting the first cord to the first and second handles.

15. The jump rope according to claim 14, wherein the first end of the first cord is secured to the first bearing by a first pin integral with the first end of the first cord and the second end of the first cord is secured to the second bearing by a second pin integral with the second end of the first cord, wherein the first and second pins respectively prevent the first and second solid bearings from slipping off of the first cord and for ease of adjusting length of the first cord.

16. A resistance jump rope for strength and cardiovascular conditioning, comprising:

a first handle including a terminal first end and a terminal second end and a second handle including a first end and a second end;

a first elongated, flexible cord sized and shaped to move in a circular arc about an individual as the cord passes by the legs of the individual having a first end and a second end, the first end of the cord being coupled to the first end of the first handle and the second end of the cord being coupled to the first end of the second handle;

first and second solid bearings respectively mounting the first cord to the first and second handles; and a second resilient cord, substantially shorter than the first cord, the second cord including a first end and a second end, wherein the first end of the second cord is secured to the first handle and the second end of the second cord is secured to the second handle such that the second resilient cord extends between the second end of first handle and the second end of the second handle; wherein an individual using the jump rope may rotate the handles such that the first cord moves in a circular arc over which the individual may jump as it passes by the legs of the individual and the individual may move the first and second handles away from each other to create resistance in the second cord to isometrically exercise the upper body of the individual.

17. The jump rope according to claim 16, wherein the first handle includes an end housing at the first end of the first handle, and the first end of the first cord is secured to the end housing; and the second handle includes an end housing at the first end of the second handle, and the second end of the first cord is secured to the end housing.

18. The jump rope according to claim 17, wherein the end housing of the first handle includes a tapered opening adjacent the first end of the first cord and the end housing of the second handle includes a tapered opening adjacent the second end of the first cord.

19. The jump rope according to claim 16, wherein the first end of the first cord is secured to the first bearing by a first pin integral with the first end of the first cord and the second end of the first cord is secured to the second bearing by a second pin integral with the second end of the first cord, wherein the first and second pins respectively prevent the first and second solid bearings from slipping off of the first cord and for ease of adjusting length of the first cord.

* * * * *